US005797547A

United States Patent [19]

Duncan

[11] Patent Number: 5,797,547

[45] Date of Patent: Aug. 25, 1998

[54] METHODS AND APPARATUS FOR DELAMINATING SEDIMENTARY MICA

[75] Inventor: Donald H. Duncan, Spruce Pine, N.C.

[73] Assignee: Duncan Technologies, Spruce Pine, N.C.

[21] Appl. No.: 661,881

[22] Filed: Jun. 12, 1996

[51] Int. Cl.[6] ..... B02C 19/12

[52] U.S. Cl. ..... 241/4; 241/27; 241/246; 241/247

[58] Field of Search ..... 241/247, 46.11, 241/42, 76, 79.1, 79.2, 80, 4, 17, 21, 24.11, 27, 163, 228, 246, 282.1, 275, 46.17

[56] References Cited

U.S. PATENT DOCUMENTS

| | | | |
|---|---|---|---|
| 1,921,914 | 8/1933 | Edman | 241/76 X |
| 2,177,358 | 10/1939 | Atwood | 241/4 X |
| 2,999,649 | 9/1961 | Radcliffe | 241/4 X |
| 3,417,929 | 12/1968 | Secrest | 241/264 X |
| 3,897,014 | 7/1975 | Luthi | 241/163 X |
| 4,821,966 | 4/1989 | Ephraim et al. | 241/247 X |
| 4,881,690 | 11/1989 | Maier | 241/247 X |
| 5,037,034 | 8/1991 | Duncan | 241/247 |
| 5,137,217 | 8/1992 | Duncan | 241/4 |
| 5,377,918 | 1/1995 | Garcia Pastor et al. | 241/46.17 |

FOREIGN PATENT DOCUMENTS

| | | | |
|---|---|---|---|
| 612843 | 11/1926 | France | 241/247 |
| 11786 | of 1886 | United Kingdom | 241/247 |

*Primary Examiner*—John M. Husar
*Attorney, Agent, or Firm*—Myers Bigel Sibley & Sajovec, L.L.P.

[57] ABSTRACT

A superior grade of flake mica product may be produced by applying shear forces to sedimentary mica to delaminate it into flakes. Shear forces are applied by rotating a plurality of arcuate blades within a confined cylindrical chamber containing the mica, such that the mica is forced between an outer portion of each blade and the chamber. Each one of the arcuate blades is curved to define an end portion that is spaced from, and substantially concentric with, a portion of the cylindrical chamber.

19 Claims, 4 Drawing Sheets

METHODS AND APPARATUS FOR DELAMINATING SEDIMENTARY MICA

FIELD OF THE INVENTION

The present invention relates generally to silicate minerals, and more particularly to sedimentary mica.

BACKGROUND OF THE INVENTION

Mica comprises a class of silicate minerals having perfect basal cleavage and widely varying chemical compositions. The most common species of mica are muscovite $KAl_2(AlSi_3O_{10})(OH)_2$, phlogopite $K(Mg,Fe)_3(AlSi_3O_{10})(OH)_2$, and biotite $K(Fe,Mg)_3(AlSi_3O_{10})(OH)_2$. These species are rock forming minerals occurring within a variety igneous, metamorphic and sedimentary rocks, as well as in many mineral deposits.

Mica has a variety of commercial uses in both sheet form and in flake form. Flake mica is used as both a filler and coating in paint, wallpaper, plastics, cosmetics, and a variety of other products. Flake mica is typically produced by grinding crude mica, which is typically in the form of books or stacks of numerous mica platelets bonded together in a face-to-face configuration. The grinding process breaks up these stacks to produce individual platelets of mica. Grinding is typically performed in Chaser mills, and the like, having rollers or balls that roll over the mica for a period of generally six to eight hours per ton. Delamination enhances the sheen and slip of the mica, and makes a more desirable product.

The mills currently used are designed to grind coarse mica ore derived from igneous intrusive rock and metamorphic schist wherein the mesh size is generally greater than or equal to one-hundred (100) mesh. Unfortunately, sedimentary mica, due to its naturally fine size (generally less than or equal to 100 mesh), will not delaminate in these mills at a production rate that is economical. Consequently, sedimentary mica is typically not used to produce mica flakes.

In addition, the kaolin and sand industries typically avoid mining clays containing sedimentary mica. The platey nature of sedimentary mica causes problems during screening steps in kaolin production processes. The kaolin industry typically processes kaolin having a mesh size less than or equal to three-hundred-twenty-five (325) mesh. Consequently, sedimentary mica contained within the kaolin slurry often causes blinding of the screens, thereby hampering production. In addition, ultra-fine mica retards slurry makedown and is detrimental to Brookfield viscosity, because of its platey shape and dielectric properties.

The sand industry avoids mining sand from areas containing a high percentage of sedimentary mica. Unfortunately, sedimentary mica is present in most sand deposits. Consequently, during sand production, a majority of the washing process steps are for the purpose of removing silts and sedimentary mica due to their detrimental properties. Because of the friable, flexible, and platey nature of sedimentary mica, the dried strength of mortar and concrete is reduced when sedimentary mica is present. Furthermore, because of its high surface area, sedimentary mica platelets are highly absorptive of water. Consequently, the presence of sedimentary mica in concrete sand may cause the water demand for a mixture to increase beyond normal levels. For certified concrete mixtures, water added beyond specifications may render the concrete unusable.

SUMMARY OF THE INVENTION

It is therefore an object of the present invention to provide an economical method for delaminating sedimentary mica.

It is another object of the present invention to economically produce a superior grade of flake mica product from sedimentary mica, thereby creating new uses for sedimentary mica, which has, until now, been generally avoided.

These and other objects are accomplished, according to the present invention, by methods and apparatus for producing delaminated mica flakes from sedimentary mica. An apparatus for continuously delaminating sedimentary mica, as well as other minerals and materials, comprises a frame and a delaminator housing secured to the frame. The delaminator includes a delaminating chamber having a cylindrical inner surface between opposing first and second end portions. The first end portion has a first opening therein, and the second end portion has a second opening therein.

An impeller shaft is rotatably secured to the frame and extends through the first opening into the delaminating chamber. An impeller is mounted on the impeller shaft in the delaminating chamber, and has a plurality of arcuate blades extending outwardly therefrom. Each one of the arcuate blades is curved, when viewed from the impeller shaft axial direction, to define an end portion distal from the impeller, such that the end portion is spaced from and substantially concentric with a portion of the cylindrical inner surface. For delaminating sedimentary mica, the end portion of each blade is spaced from the delaminating chamber inner surface a distance of between about one-twentieth of an inch and three inches (0.05"–3.0").

The delaminator includes a mechanism for rotating the impeller shaft. The delaminator also includes a hopper, having a feeder screw rotatably mounted therein, for supplying sedimentary mica into the delaminating chamber through the second opening. The feeder screw is aligned with the second opening to provide a continuous supply of mica into the delaminating chamber. A drive mechanism for rotating the feeder screw may be provided.

The delaminator also may include an agitator shaft, having a plurality of projections extending outwardly therefrom, rotatably mounted within the hopper for breaking up mica aggregations. A drive mechanism may be provided for rotating the agitator shaft. The delaminator may include a mechanism for preventing delaminated mica from aggregating adjacent the first opening. This mechanism may include at least one projection extending outwardly from the impeller shaft adjacent the first opening. The delaminator may include a lining removably secured to the end portion of each blade, and to the delaminating chamber inner surface. The lining for both the end portion of each blade and the delaminating chamber inner surface may be formed of stainless steel, mild steel, cast iron, plastics, and the like.

A delaminated mica product, comprising a plurality of sedimentary mica flakes, substantially all of which are less than forty-four microns (44μ), may be produced, according to the present invention, by rotating a plurality of arcuate blades within a cylindrical chamber containing sedimentary mica, such that the mica is forced between an outer portion of each blade and the cylindrical chamber. Each arcuate blade has an outer portion that is spaced from and substantially concentric with a portion of the cylindrical chamber.

The present invention is advantageous because otherwise unused sedimentary mica can now be processed to produce a superior grade of mica flake product economically. The delaminator, according to the present invention, produces mica flakes that are clearly differentiated from other wet ground mica products because the mica is not ground into a powder. In addition, because of the manner in which shear forces are applied to the mica books, delamination is obtained quickly as compared with prior art delamination methods. Consequently, sedimentary mica and other minerals and materials can be delaminated and processed on a continuous basis. Furthermore, the present invention is advantageous in that it does not require the use of grinding media.

DETAILED DESCRIPTION OF PREFERRED EMBODIMENTS

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Conventional methods of delaminating mica have only been able to achieve a flake mica product having a bulk density of about eight to fourteen pounds per cubic feet (8–14 lbs/ft$^3$), and a G.E. brightness of about sixty-five to eighty (65–80). G.E. brightness for mica is measured using a five-hundred forty-seven (547) nanometer wavelength and green filter. The term "aspect ratio", as used herein, is the width of a particle divided by the particle's thickness. It is desirable to have a high aspect ratio for flake mica used as a coating and filler.

Conventional methods of delaminating mica typically involve a wet grinding process, wherein mica having a moisture content of about twenty-five to thirty-five percent (25%–35%) is processed in batches within Chaser or Muller mills. Typically, a charge of mica is placed within a mill and large wheels or rollers roll over the mica as the mill is rotated, causing the mica to delaminate for a period of several to many hours.

Figure 1:
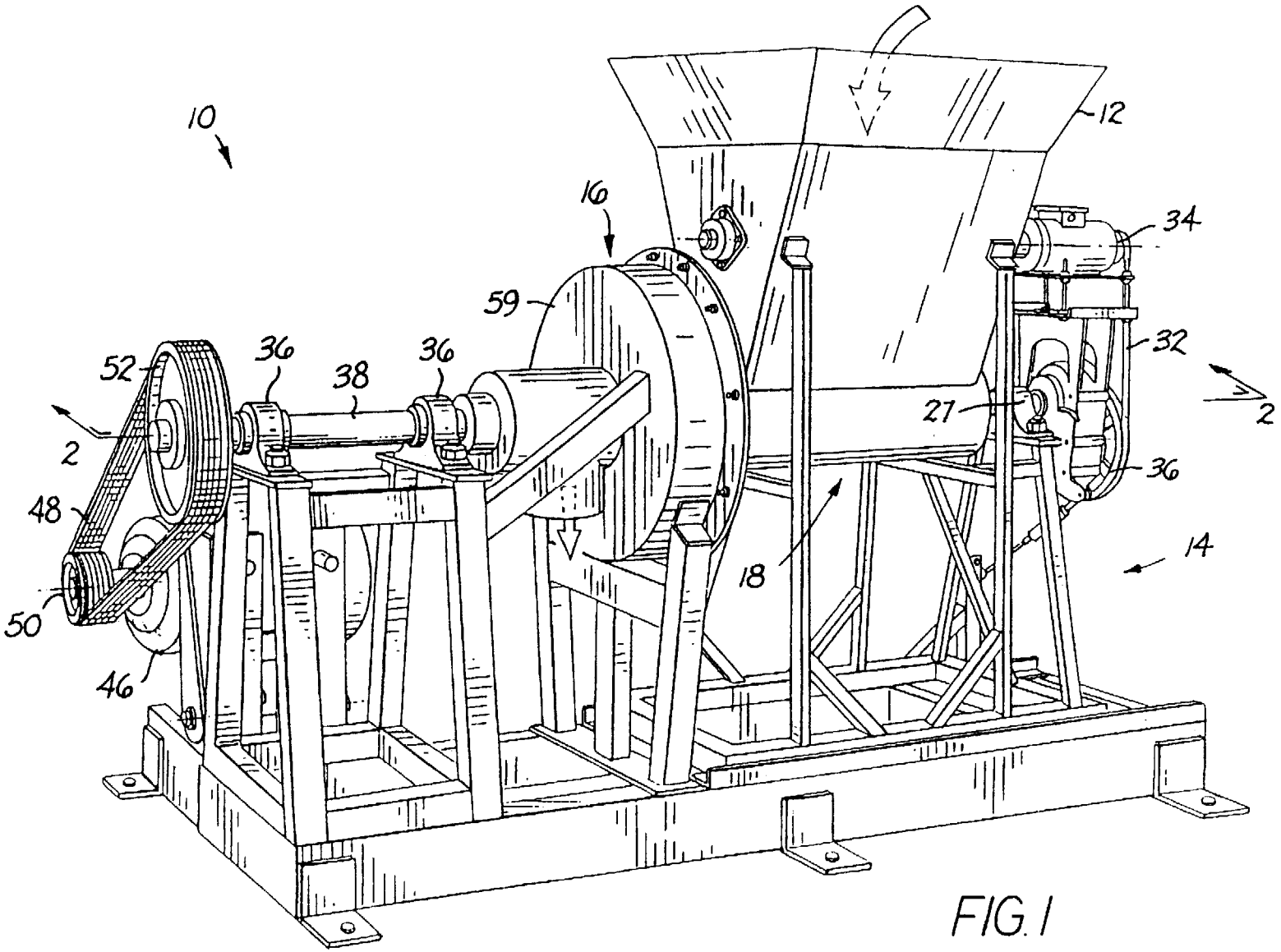
FIG. 1 illustrates a delaminator for delaminating sedimentary mica, according to the present invention.
Figure 2:
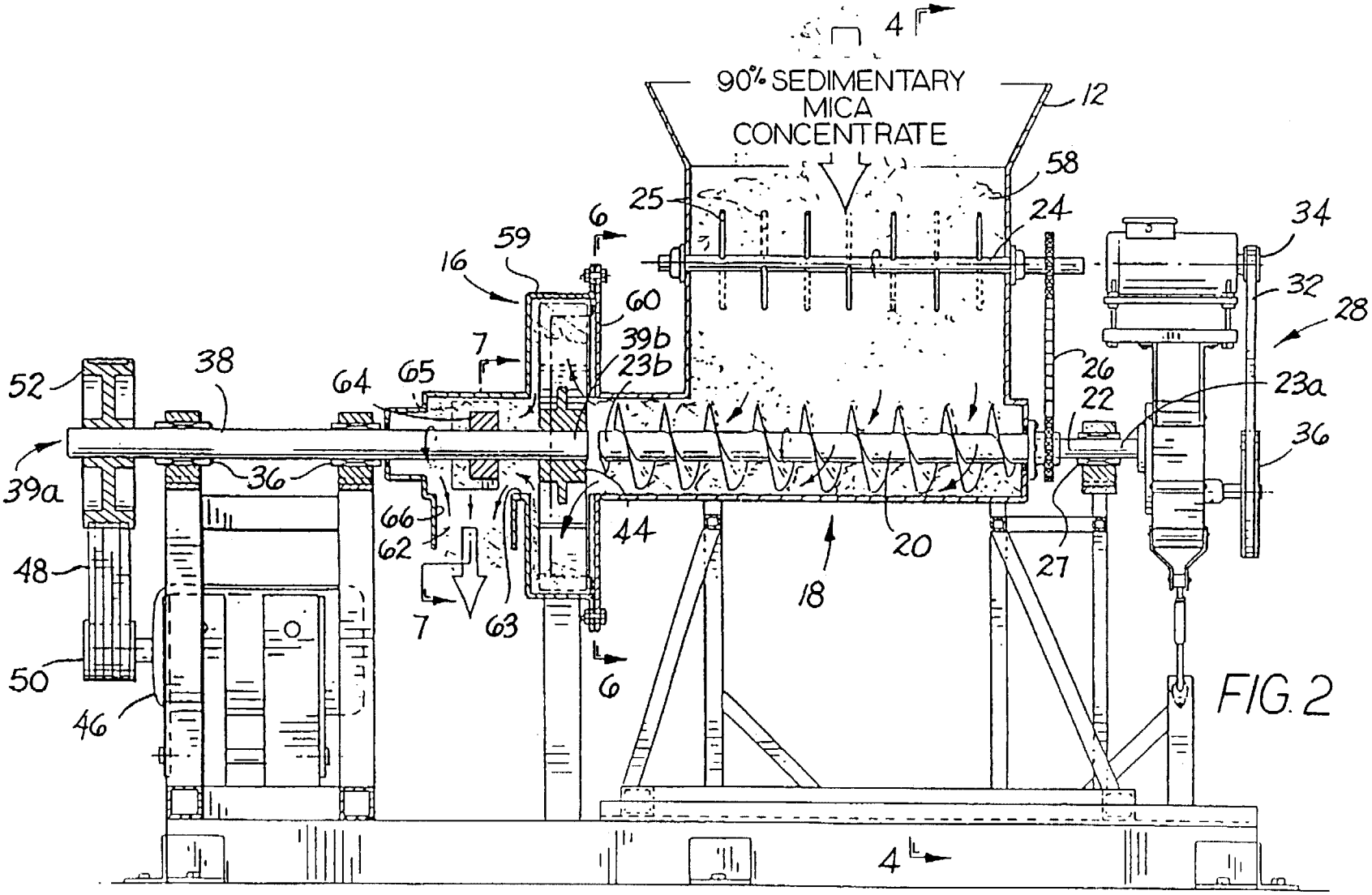
FIG. 2 is a cross-sectional view of the delaminator illustrated in FIG. 1, taken along lines 2—2.
Figure 3:
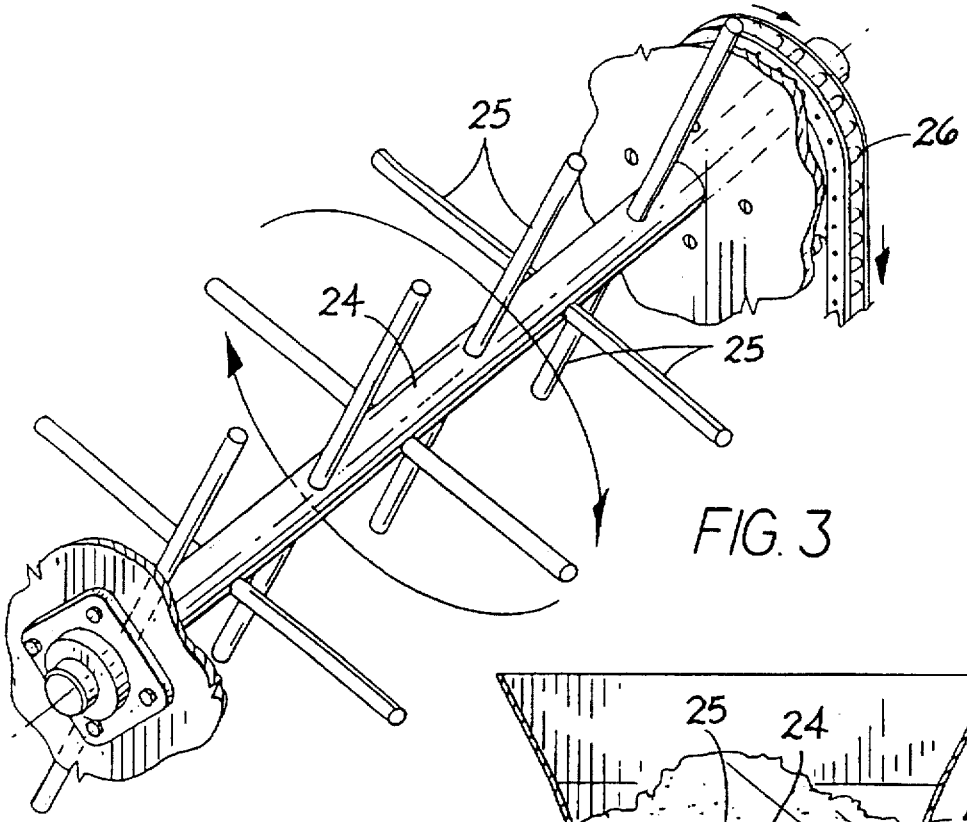
FIG. 3 illustrates an agitator for breaking up clumps of mica in the hopper of the delaminator illustrated in FIG. 1.
Figure 4:
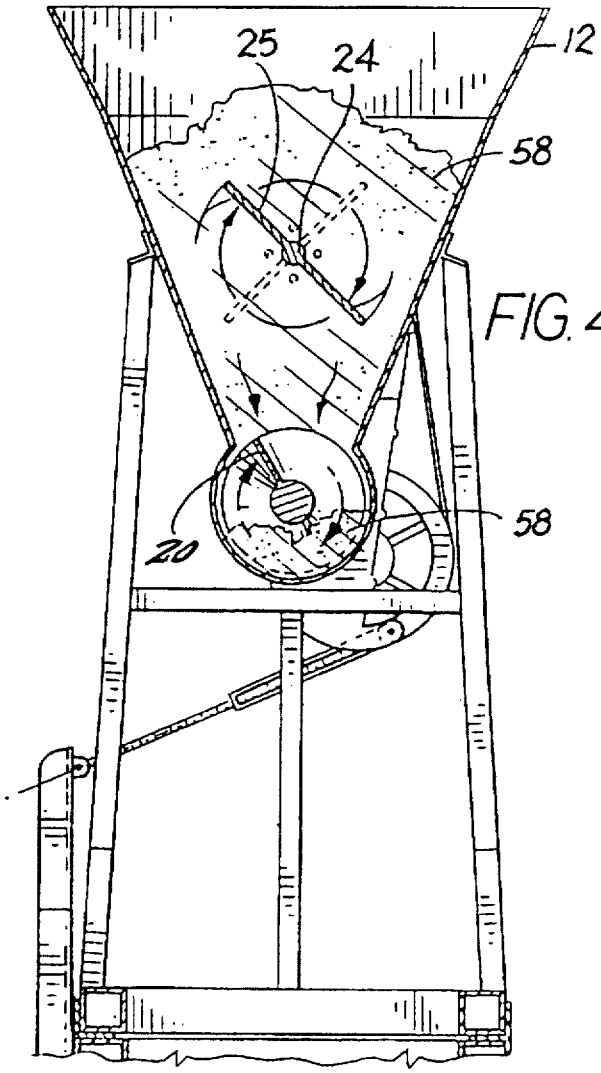
FIG. 4 is a cross-sectional view of the delaminator illustrated in FIG. 2, taken along lines 4—4.

Referring now to FIG. 1, a delaminator for delaminating sedimentary mica 10, and other minerals and materials, according to the present invention, is illustrated. The delaminator 10 includes a hopper 12 supported by a frame 14, delaminating chamber 16, and feeder system 18. The frame 14 elevates the hopper 12 to facilitate feeding mica concentrate into the delaminating chamber 16. Referring now to FIG. 2, the feeder system 18 includes a feeder screw 20 rotated via a first drive shaft 22 having opposing first and second ends 23*a*, 23*b*. In the illustrated embodiment, the first drive shaft 22 is rotationally supported via bearings 27 and is rotated via a drive system 28 composed of a motor 30, belt 32, and pulleys 34, 36. The hopper 12 includes a rotating agitator 24 having a plurality of projections 25 extending therefrom for removing aggregations of crude ore in the hopper and for facilitating the feeding of mica into the delaminating chamber, as illustrated in FIG. 3. In the illustrated embodiment, the agitator 24 is rotated via a belt or chain 26 driven from the first drive shaft first end 23*a*.

Referring back to FIG. 2, a second drive shaft 38, having first and second opposing ends 39*a*, 39*b*, extends the second end into the delaminating chamber 16 with an impeller 44 mounted thereon. Preferably, the second drive shaft 38 is driven at the opposing first end 39*a* via a motor 46, belt 48, and pulleys 50, 52. However, various means for rotating the shaft, including manual devices, may be utilized. The second drive shaft 38 is supported via bearings 36.

The delaminating chamber 16 is configured to impart shear forces on the mica books contained therewithin to cleave individual platelets therefrom. The delaminator 10 imparts shear forces in a direction generally parallel to the cleavage planes in each book, without subjecting the mica to bending and compressive forces, as is the case with conventional mica milling devices. Conventional milling devices, through the use of rollers, balls, and variously-shaped impellers, impart a "mortar and pestle" action on platey minerals such as mica, wherein larger particles are ground into powder, rather than being cleaved into individual platelets. By contrast, the present invention delaminates each book of sedimentary mica into very small flakes through the application of shear forces, and avoids grinding the mica into a powder. The shear forces imparted upon the mica also generates heat due to friction. This heat facilitates separation of individual platelets from the mica books.

Figure 5:
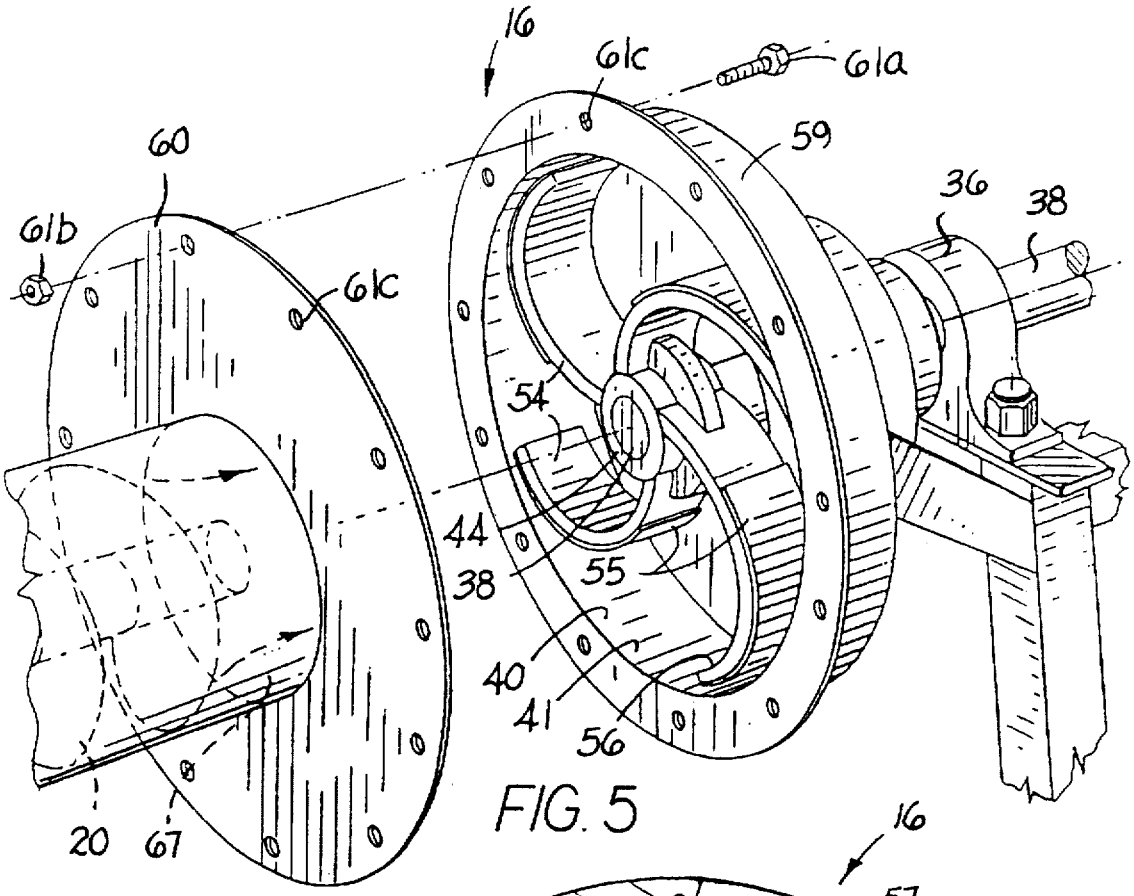
FIG. 5 is an exploded perspective view of the delaminating chamber in the delaminator illustrated in FIG. 1.
Figure 6:
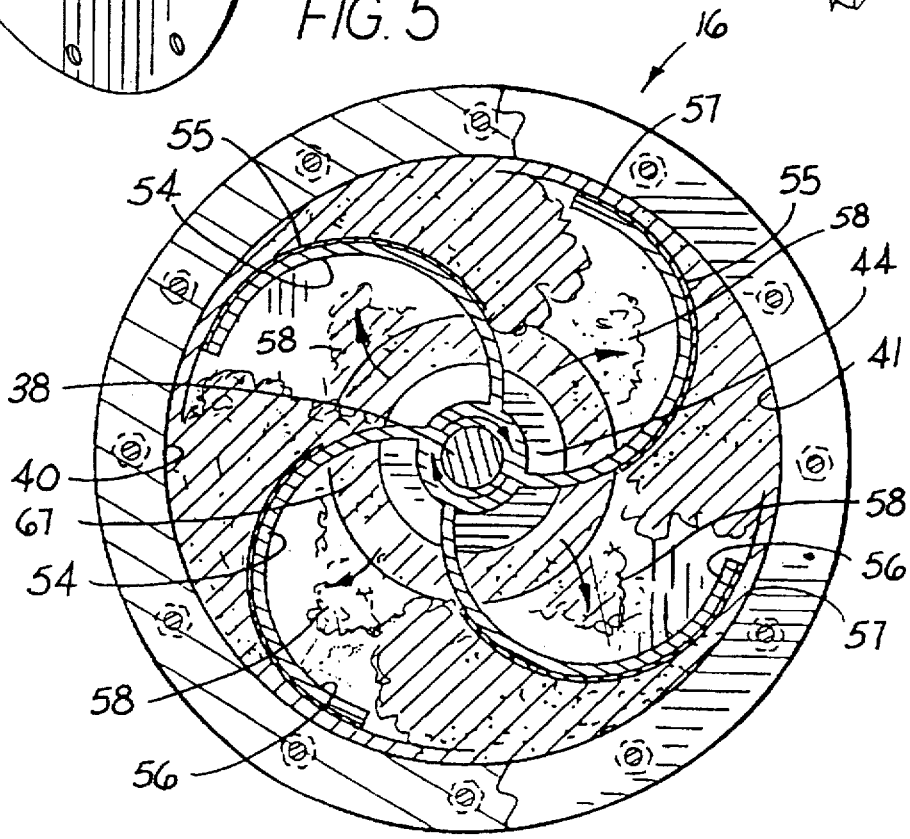
FIG. 6 is a cross-sectional view of the delaminator illustrated in FIG. 2, taken along lines 6—6.

Referring now to FIGS. 5 and 6, the delaminating chamber 16 is illustrated. The delaminating chamber 16, defined by housing 59 and cover 60 in the illustrated embodiment, is generally cylindrical in shape and the impeller 44 is configured to rotate within the chamber without contacting the inner surface 40. Preferably, the inner surface 40 of the delaminating chamber 16 is lined with a replaceable lining 41 made from stainless steel, mild steel, cast iron, plastics, and the like. The delaminating chamber 16 is not limited to the horizontal orientation illustrated. The delaminating chamber 16 may be oriented vertically, diagonally, or in any orientation desired.

The impeller 44 has multiple curved blades 54 extending outwardly from the second drive shaft 38 towards the inner surface of the delaminating chamber in an arcuate shape, as illustrated in FIG. 6. The number of blades on an impeller typically depends on the size of the delaminating chamber. For large delaminating chambers (typically 24" in diameter and larger), four (4) or more blades may be used. For delaminating chambers smaller than 24", two (2) to four (4) blades are preferred. Exemplary dimensions for each blade in a 30" delaminator, according to the present invention, are as follows: three-quarters of an inch (0.75") thickness; four inches (4.0") width; and twenty and three-quarters inches (20.75") length. As would be understood by those having skill in the art, the present invention is not limited to these blade dimensions. Blade dimensions may vary according to the size of the particular delaminator, the speed of operation, and the type of material delaminated therewithin.

The blades 54 may be formed from various materials including mild steel, stainless steel, or hard surfaced metal. The material selected depends on the abrasiveness of the mineral being delaminated. Each impeller blade 54 preferably has a replaceable lining 55, made from stainless steel, mild steel, cast iron, plastics, and the like, attached along an end portion 56 of the blade adjacent the delaminating chamber inner surface 40. Preferably, the end portion 56 of each blade 54, distal from the impeller, defines an arc spaced from and substantially concentric with the delaminating chamber inner surface 40. The clearance between the arc defined by the end portion 56 of each blade 54 and the delaminating chamber 16 inner surface 40 is preferably between about one-twentieth of an inch (0.05") and three inches (3") for sedimentary mica, and is referred to as the "pinch point" 57. The replaceable linings for the delaminating chamber inner surface and the blades permits the pinch point dimension to be maintained as well as protect the blades and delaminating chamber from wear.

The centrifugal force of the spinning impeller 44 accelerates the mica outwardly to the end portion 56 of each blade 54 where it is slowed due to friction and drag with the delaminating chamber inner surface 40. The movement of each blade 54 over the mica causes a shear force to be exerted on the mica at each pinch point 57. Because of the curved configuration of the outer portion 56 of each blade 54, the shear forces are in a direction generally parallel to the books of mica, thereby breaking the covalent cleavage bonds of each platelet in a book.

The shear force imparted upon the mica books also generates heat due to friction. This heat facilitates the separation of layers of the mica plates. A cooling system such as a water jacket (not shown) may be incorporated into the housing 59 surrounding the delaminating chamber 16 to reduce any detrimental effects caused by heat.

Preferably, the impeller is rotated between about six-hundred (600) rpm and twelve-hundred (1,200) rpm when delaminating sedimentary mica. However, other speeds may be used depending on the size of the pinch point 57, and the type of mineral being delaminated. On average, sedimentary mica 58 resides within the delaminating chamber 16 for between about two (2) minutes and twelve (12) minutes. However, the residence time within the delaminating chamber may vary depending on the size of the pinch point 57, the speed of the impeller, and the type of mineral being delaminated. Water may be added to the material within the delaminating chamber 16 as needed.

In the illustrated embodiment, the delaminating chamber 16 may be continuously fed with sedimentary mica 58, or other minerals to be delaminated, via the feeder screw 20 through an opening 67 in the housing cover 60. In the illustrated embodiment, the housing cover 60 is secured to the delaminating chamber housing 59 by a plurality of bolts 61*a* and nuts 61*b* via a plurality of peripherally-located apertures 61*c* in both the housing cover and delaminating chamber housing. Preferably, the diameter, pitch, and rpm of the feeder screw 20 are selected to maintain the delaminating chamber 16 with a predetermined volume of sedimentary mica 58 to be delaminated at all times.

Figure 7:
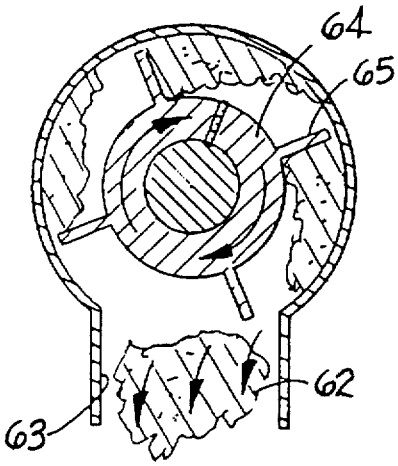
FIG. 7 is a cross-sectional view of the delaminator illustrated in FIG. 2, taken along lines 7—7.

Referring back to FIG. 2, the delaminated mica flakes 62 are discharged from the delaminating chamber 16 via an opening 63 in the delaminating chamber housing 59 and via a discharge nozzle 66. A hub 64 having at least one projection 65 extending outwardly from the second drive shaft 38 is positioned adjacent the discharge nozzle 66 to facilitate the removal of delaminated product from the delaminating chamber 16, as illustrated in FIG. 7. The hub 64 may have any configuration and number of projections 65 whereupon the removal of delaminated product is facilitated.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. An apparatus for continuously delaminating sedimentary mica comprising:

a frame;

a delaminator housing secured to said frame and comprising a delaminating chamber therein having a continuous cylindrical inner surface between opposing first and second end portions, said first end portion having a first opening therein, said second end portion having a second opening therein;

an impeller shaft rotatably secured to said frame and extending through said first opening into said delaminating chamber;

an impeller mounted on said impeller shaft in said delaminating chamber, said impeller having a plurality of arcuate blades extending outwardly therefrom, each one of said arcuate blades curved when viewed from the impeller shaft axial direction to define an end portion distal from said impeller, wherein said end portion is spaced from and substantially concentric with any portion of said continuous cylindrical inner surface to define a pinch point having a dimension of between about 0.05 inches and 3.0 inches;

impeller shaft drive means for rotating said impeller shaft; and mica supply means adjacent said second opening for continuously supplying sedimentary mica into said delaminating chamber through said second opening.

2. A delaminating apparatus according to claim 1, wherein said mica supply means comprises a hopper having a feeder screw rotatably mounted therein, said feeder screw aligned with said second opening for providing a continuous supply of mica into said delaminating chamber.

3. A delaminating apparatus according to claim 2, further comprising feeder screw drive means for rotating said feeder screw.

4. A delaminating apparatus according to claim 2, further comprising an agitator shaft having a plurality of projections extending outwardly therefrom, said agitator shaft rotatably mounted within said hopper for breaking up mica aggregations within said hopper.

5. A delaminating apparatus according to claim 4, further comprising agitator shaft drive means for rotating said agitator shaft.

6. A delaminating apparatus according to claim 1, further comprising means for preventing delaminated mica from aggregating adjacent said first opening.

7. A delaminating apparatus according to claim 6, wherein said means for preventing the aggregation of delaminated mica adjacent said first opening comprises at least one projection extending outwardly from said impeller shaft adjacent said first opening.

8. A delaminating apparatus according to claim 1, further comprising a lining removably secured to said end portion of each blade.

9. A delaminating apparatus according to claim 8, wherein said lining is formed of material selected from the group consisting of carbon and alloy steel, stainless steel, cast iron, and plastics.

10. A delaminating apparatus according to claim 1, further comprising a lining removably secured to said delaminating chamber inner surface.

11. A delaminating apparatus according to claim 10, wherein said lining is formed of material selected from the group consisting of carbon and alloy steel, stainless steel, cast iron, and plastics.

12. An apparatus for continuously delaminating minerals comprising:

a cylindrical delaminating chamber having a continuous inner surface positioned between opposing first and second end portions, said first end portion having a first opening therein;

an impeller shaft extending through said first opening into said delaminating chamber;

an impeller mounted on said impeller shaft in said delaminating chamber, said impeller having a plurality of arcuate blades extending outwardly therefrom, each one of said arcuate blades curved when viewed from the impeller shaft axial direction to define an end portion distal from said impeller, wherein said end portion is spaced from and substantially concentric with any portion of said continuous cylindrical inner surface to define a pinch point having a dimension of between about 0.05 inches and 3.0 inches; and impeller shaft drive means for rotating said impeller shaft.

13. An apparatus according to claim 12, further comprising mineral supply means for supplying minerals into said delaminating chamber.

14. A delaminating apparatus according to claim 12, further comprising a lining removably secured to said end portion of each blade.

15. A delaminating apparatus according to claim 14, wherein said lining is formed of material selected from the group consisting of carbon and alloy steel, stainless steel, cast iron, and plastics.

16. A delaminating apparatus according to claim 12, further comprising a lining removably secured to said delaminating chamber inner surface.

17. A delaminating apparatus according to claim 16, wherein said lining is formed of material selected from the group consisting of carbon and alloy steel, stainless steel, cast iron, and plastics.

18. A method of delaminating minerals into flakes, comprising rotating a plurality of arcuate blades within a continuous cylindrical chamber containing a mineral, such that said mineral is forced between an outer portion of each blade and said continuous cylindrical chamber, wherein said outer portion of each one of said arcuate blades is spaced from any portion of said cylindrical chamber between about 0.05 inches and 3.0 inches.

19. A method according to claim 18, wherein said mineral is sedimentary mica.

* * * * *